US009513021B2

(12) United States Patent
Kato et al.

(10) Patent No.: US 9,513,021 B2
(45) Date of Patent: Dec. 6, 2016

(54) BLOWER AND HEAT PUMP APPARATUS USING THE SAME

(75) Inventors: Yasuaki Kato, Tokyo (JP); Takahide Tadokoro, Tokyo (JP); Masanobu Baba, Tokyo (JP); Hiroyuki Takada, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 284 days.

(21) Appl. No.: 13/123,174

(22) PCT Filed: Oct. 29, 2009

(86) PCT No.: PCT/JP2009/068567

§ 371 (c)(1),
(2), (4) Date: Apr. 7, 2011

(87) PCT Pub. No.: WO2010/053037

PCT Pub. Date: May 14, 2010

(65) Prior Publication Data

US 2011/0192186 A1 Aug. 11, 2011

(30) Foreign Application Priority Data

Nov. 4, 2008 (JP) ..... 2008-283519

(51) Int. Cl.
*F01D 25/24* (2006.01)
*F24F 1/38* (2011.01)
(Continued)

(52) U.S. Cl.
CPC ..... *F24F 1/38* (2013.01); *F04D 29/162* (2013.01); *F04D 29/164* (2013.01);
(Continued)

(58) Field of Classification Search
CPC ..... F24F 1/0007; F24F 1/0022; F24F 1/38; F24F 1/40; F24F 7/06; F24F 13/06; F24F 13/20; F04D 29/52; F04D 29/526; F04D 29/54–29/547; F04D 19/00; F04D 19/002
(Continued)

(56) References Cited

U.S. PATENT DOCUMENTS 3,079,766 A * 3/1963 Abbott et al. ..... 62/280
5,619,863 A * 4/1997 Kil ..... 62/428
(Continued)

FOREIGN PATENT DOCUMENTS

CN 1406319 A 3/2003
EP 1 357 296 B1 6/2006
(Continued)

OTHER PUBLICATIONS

Definition of Surround by Merriam-Webster and Google.*
(Continued)

*Primary Examiner* — Ryan J Walters
*Assistant Examiner* — Antonio R Febles
(74) *Attorney, Agent, or Firm* — Buchanan Ingersoll & Rooney PC

(57) ABSTRACT

The rear side outer peripheral edge of a propeller fan rotated and driven by a motor, of a propeller fan drive unit, is surrounded by a bell mouth. An upper plate, a lower plate, a side plate, and a machine room plate constitute an air duct at the suction side, outside the radial direction of the propeller fan. The cross-section of the bell mouth, at a first position in the vicinity where a blade of the propeller fan is closest, and where the distance between the propeller fan and the plate constituting the air duct outside the radial direction is relatively narrow, is made to be such that an expansion angle θ1 of the bell mouth suction side is made small. The overlapped height Hb of the propeller fan and the
(Continued)

bell mouth is made large against a cross-section at a second position where the distance between the propeller fan and a plate is relatively large. The shape of the cross-section of the bell mouth is made to change gradually between the first position and the second position.

12 Claims, 8 Drawing Sheets

(51) Int. Cl.
*F04D 29/16* (2006.01)
*F04D 29/52* (2006.01)
*F04D 29/66* (2006.01)
*F24F 1/40* (2011.01)

(52) U.S. Cl.
CPC ..... *F04D 29/526* (2013.01); *F04D 29/663* (2013.01); *F24F 1/40* (2013.01)

(58) Field of Classification Search
USPC ..... 62/238.6, 238.7, 411, 426, 427, 455, 418,62/419; 415/220
See application file for complete search history.

(56) References Cited

U.S. PATENT DOCUMENTS

| | | | | | |
|---|---|---|---|---|---|
| 5,967,748 | A | * | 10/1999 | Jang | 415/211.1 |
| 2002/0152760 | A1 | * | 10/2002 | Okuda et al. | 62/259.2 |
| 2005/0226721 | A1 | * | 10/2005 | Higashida | 415/206 |
| 2005/0260075 | A1 | * | 11/2005 | Arinaga et al. | 415/220 |
| 2005/0281672 | A1 | * | 12/2005 | Parker et al. | 416/95 |
| 2007/0214816 | A1 | * | 9/2007 | Fukunaga et al. | 62/238.6 |
| 2008/0019826 | A1 | * | 1/2008 | Arinaga et al. | 415/206 |

FOREIGN PATENT DOCUMENTS

| | | | | | |
|---|---|---|---|---|---|
| JP | 3-233198 | A | | 10/1991 | |
| JP | 7-117077 | B2 | | 12/1995 | |
| JP | 2769211 | B2 | | 6/1998 | |
| JP | 2000-018198 | A | | 1/2000 | |
| JP | 2000018198 | A | * | 1/2000 | F04D 29/54 |
| JP | 3084790 | B2 | | 9/2000 | |
| JP | 2002-221341 | A | | 8/2002 | |
| JP | 2003-184797 | A | | 7/2003 | |
| JP | 2003184797 | A | * | 7/2003 | |
| JP | 2005-105865 | A | | 4/2005 | |
| JP | 2005105865 | A | * | 4/2005 | |
| JP | 2006-077585 | A | | 3/2006 | |
| JP | 2006077585 | A | * | 3/2006 | |

OTHER PUBLICATIONS

International Search Report (PCT/ISA/210) issued on Jan. 19, 2010, by Japanese Patent Office as the International Searching Authority for International Application No. PCT/JP2009/68567.
First Office Action dated May 2, 2013 issued by the Chinese Patent Office in Chinese Patent Application No. 200980143663.6, and an English translation thereof.
Office Action (Decision of Rejection) issued on Apr. 16, 2014, by the Chinese Patent Office in corresponding Chinese Patent Application No. 200980143663.6, and an English Translation of the Office Action. (12 pages).
Office Action issued on Nov. 5, 2013, by the Chinese Patent Office in corresponding Chinese Patent Application No. 200980143663.6, and an English Translation of the Office Action. (11pages).
European Search Report issued on Dec. 2, 2014 by the European Patent Office, in corresponding European Patent Application No. 09824737.2 (7 pages).
Third Office Action issued Jul. 5, 2016 by the Chinese Patent Office in corresponding Chinese Patent Application No. 200980143663.6, with an English translation of the text portion thereof (10 pages).

* cited by examiner

Part A CROSS-SECTION

Part B CROSS-SECTION

BLOWER AND HEAT PUMP APPARATUS USING THE SAME

TECHNICAL FIELD

The present invention relates to a blower having a bell mouth and an impeller, and a heat pump apparatus using the blower.

BACKGROUND ART

With apparatuses provided with such as a propeller fan type blower and an outdoor unit of an air-conditioner (hereinafter, an air conditioning outdoor unit), to minimize turbulence and variations of inflow air into the blower is indispensable in order to reduce aerodynamic noises.

To achieve reduction of aerodynamic noises, it is effective to reduce a relative speed of a blade and a gas by making the diameter of an impeller large and to reduce an absolute speed of the gas by securing a passing cross sectional area of the gas.

In order to reduce turbulence and variations of inflow air into the blower, it is ideal to suction a gas with a rotation axis being the center from a sufficiently wide space which is homogeneous in the circumferential direction. However, even if taking the air conditioning outdoor unit on which a propeller fan type blower is mounted for an example, it is common that the suction space outside the radial direction of the blade is constituted by a plurality of side faces, the cross-section perpendicular to the fan rotation axis is basically a rectangular, and the extent of the space is often such that the bell mouth cannot have the a sufficiently large size whose cross-section has the same configuration for all the circumference.

Because flow vectors on the bell mouth face vary, conventional blowers elaborate a plan such that by changing a radius of curvature at the tip of the bell mouth suction side, separation of air flow in the vicinity of the bell mouth is suppressed to hold down the increase in turbulent sounds. (Refer to Patent Document 1, for example).

CITATION LIST

Patent Literature

Patent Document 1 Japanese Patent No. 2769211 (JPA-07-117077) (page 2, FIGS. 2 and 3)

SUMMARY OF INVENTION

Technical Problem

The above-mentioned conventional blower changes a curvature of the bell mouth to match ununiformity due to the location in the circumferential direction of the suction side air duct. It is possible to decrease separation of air flow flowing along the bell mouth, however, no effect is available to reduce the turbulence of the inflow air itself and noise reduction cannot be achieved disadvantageously.

The present invention is made to solve such a problem and its object is to obtain a blower that reduces the turbulence of the inflow air itself to achieve low noise even when there is ununiformity due to the location in the circumferential direction with the rotation axis of the suction side air duct being the center.

Solution to Problem

The blower according to the present invention includes a propeller fan, a propeller fan drive unit that rotates and drives the propeller fan, a bell mouth that surrounds the rear edge side outer peripheral edge of the propeller fan, and a plate in at least one direction at the outside of said propeller fan in the radial direction configuring an air duct from a suction side to a blow-out side. At a first position where the distance between the propeller fan and the plate configuring the air duct outside in the radial direction is relatively narrow, a cross-section of the bell mouth at the position in the vicinity where the blade of the propeller fan approaches the most is configured such that an expansion angle of a bell mouth suction side is made small, and overlapped height of the propeller fan and the bell mouth is made large against a cross-section at a second position where the distance between the propeller fan and a plate is relatively large. A shape of the cross-section of the bell mouth is gradually changed between the first position and the second position.

Advantageous Effects of Invention

With the blower according to the present invention, the rear edge side outer peripheral edge of the propeller fan that is rotated and driven by the propeller fan drive unit is surrounded by the bell mouth. A plate is provided in at least one direction at the outside of the propeller fan in the radial direction configuring the air duct from the suction side to the blow-out side. At the first position where the distance between the propeller fan and the plate configuring the outside air duct in the radial direction is relatively narrow, the cross-section of the bell mouth at the first position in the vicinity where the blade of the propeller fan approaches the most is configured such that the expansion angle of the bell mouth suction side is small, and overlapped height of the propeller fan and the bell mouth is large against the cross-section at the second position where the distance between the propeller fan and the plate is relatively large, and the shape of the cross-section of the bell mouth is gradually changed between the first position and the second position. Therefore, variations in the air flow flowing through the propeller fan caused by an abrupt change in the air duct chamber space is reduced because of the bell mouth having a small expansion angle at the bell mouth suction side in an abruptly changing air duct chamber space, and variations in the air flow is suppressed, so that it is effective that aerodynamic noise can be lowered.

DESCRIPTION OF EMBODIMENTS

Embodiment 1

Figure 1:
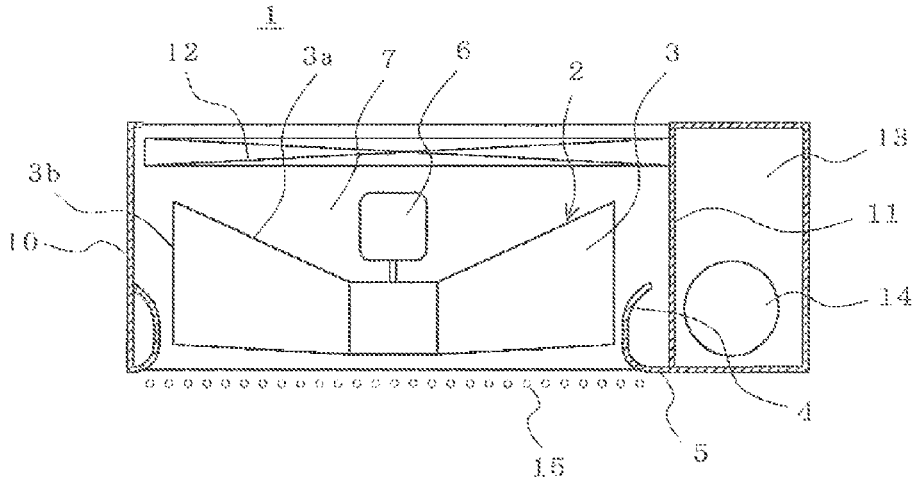
FIG. 1 is a horizontal sectional view showing an outdoor unit of an air-conditioner of Embodiment 1 of the present invention.
Figure 2:
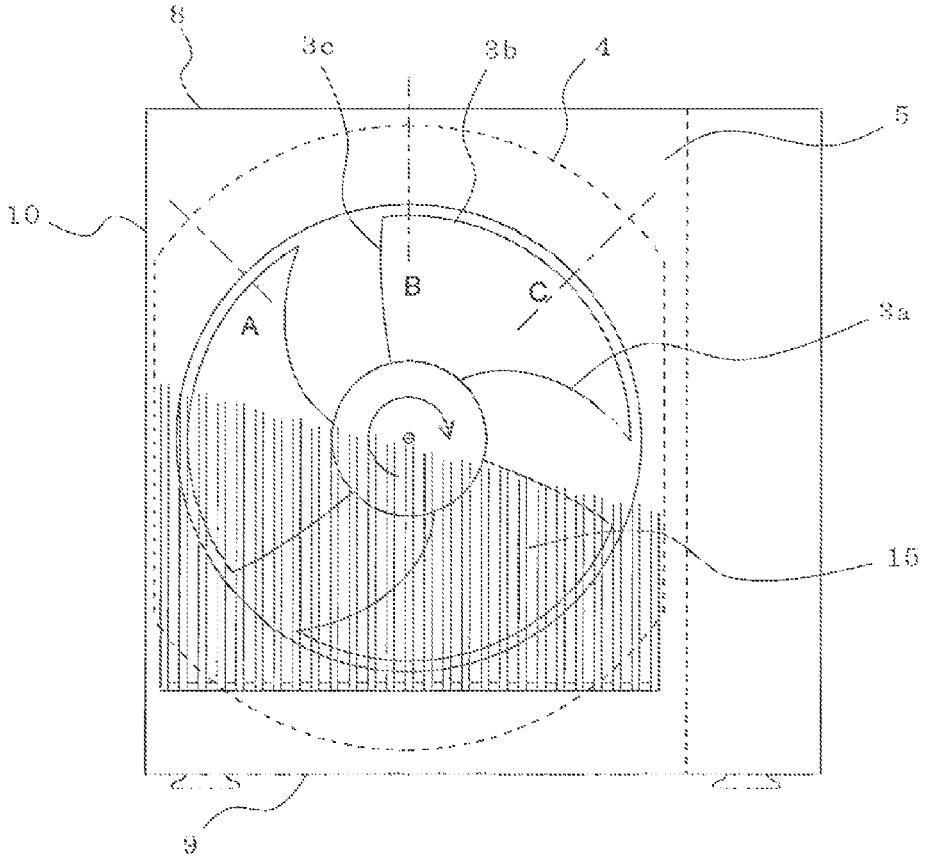
FIG. 2 is an elevation view showing the outdoor unit of the air-conditioner of Embodiment 1 of the present invention.
Figure 3:
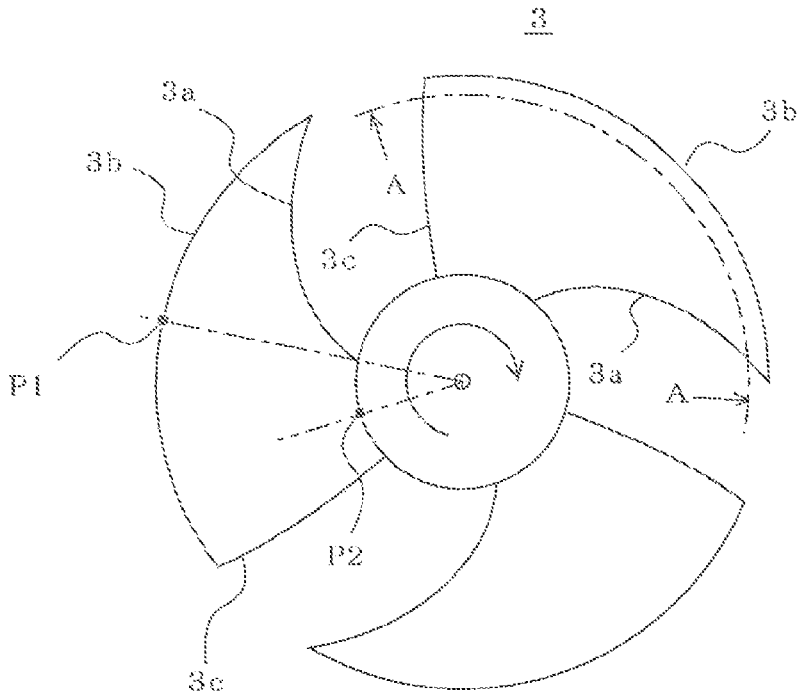
FIG. 3 is the elevation view of a propeller fan installed in the outdoor unit of the air-conditioner of Embodiment 1 of the present invention.
Figure 4:
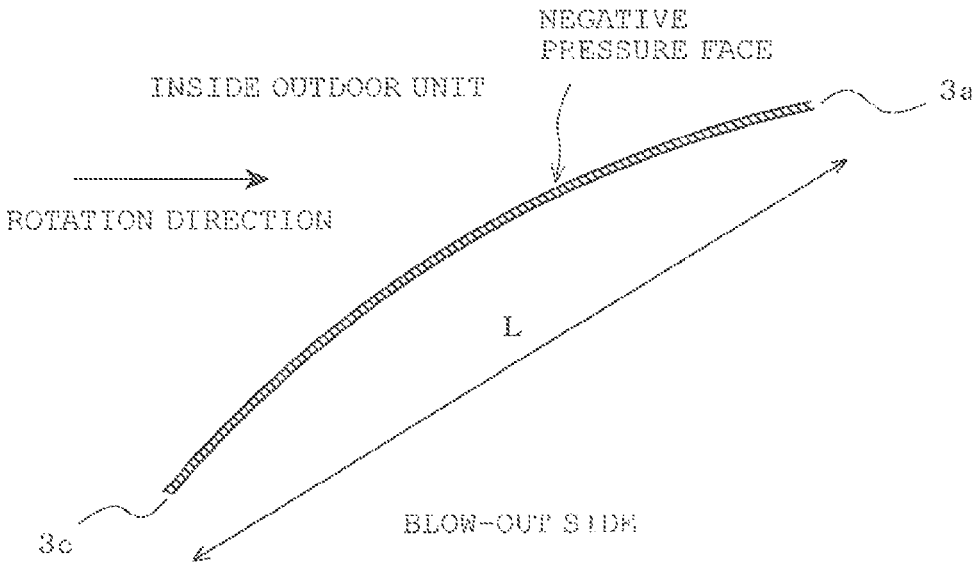
FIG. 4 is a cylindrical sectional development diagram of the propeller fan installed in the outdoor unit of the air-conditioner of Embodiment 1 of the present invention.
Figure 5:
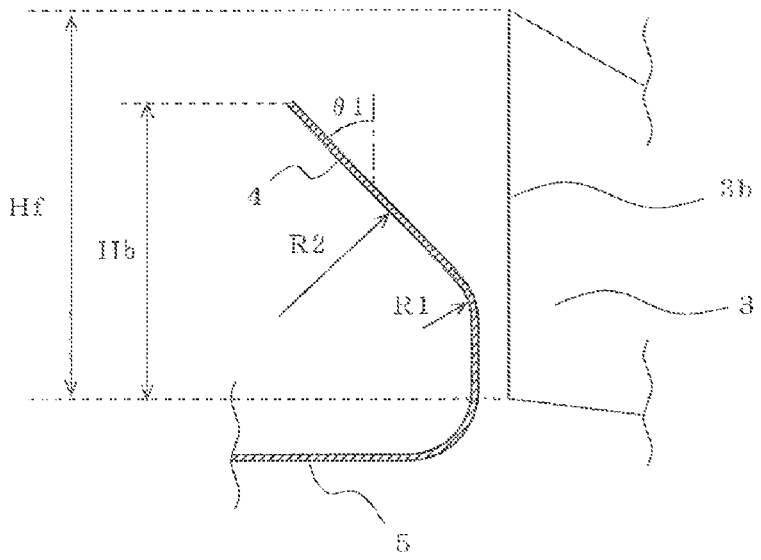
FIG. 5 is a sectional view showing a shape of a bell mouth at portion A of FIG. 2.
Figure 6:
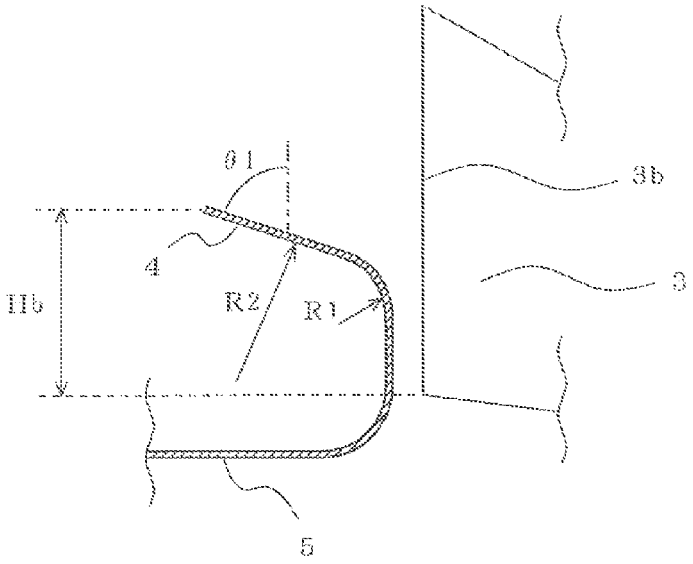
FIG. 6 is a sectional view showing a shape of a bell mouth at portion B of FIG. 2.
Figure 7:
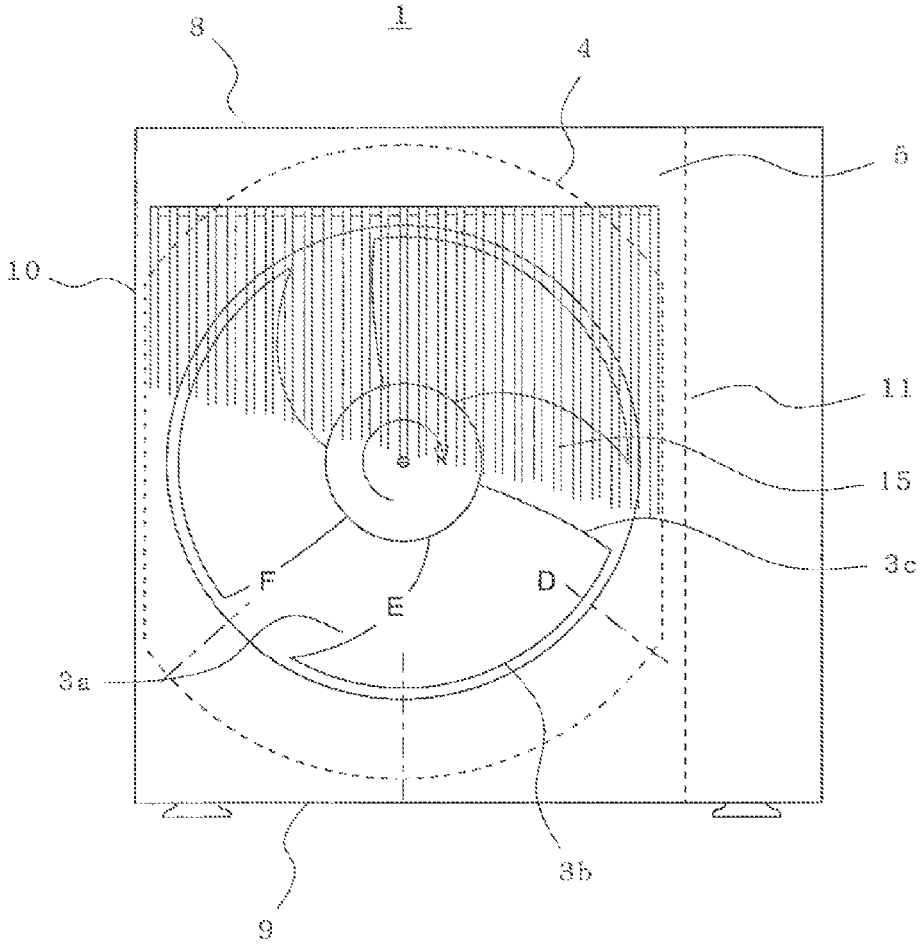
FIG. 7 is another elevation view showing the outdoor unit of the air-conditioner of Embodiment 1 of the present invention.
Figure 8:
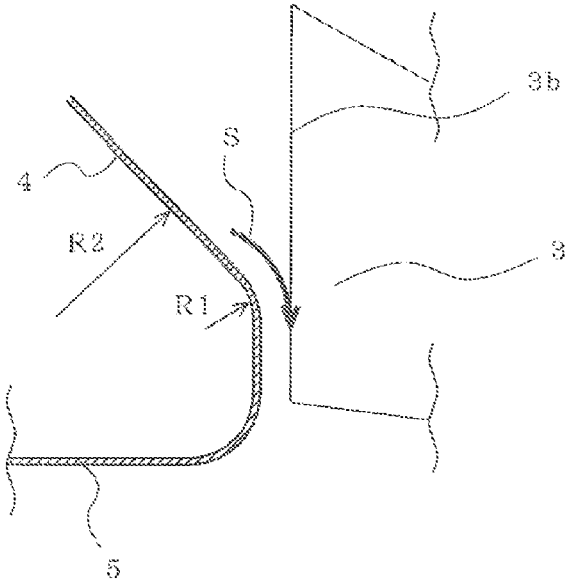
FIG. 8 is a supplemental sectional view illustrating features of the bell mouth of the outdoor unit of the air-conditioner of Embodiment 1 of the present invention.
Figure 9:
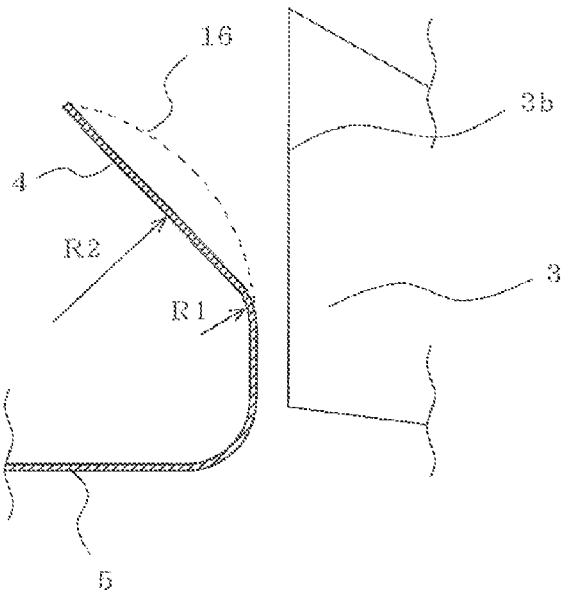
FIG. 9 is a supplemental sectional view illustrating other features of the bell mouth of the outdoor unit of the air-conditioner of Embodiment 1 of the present invention.

FIG. 1 is a horizontal sectional view showing an outdoor unit of an air-conditioner of Embodiment 1 of the present invention. FIG. 2 is an elevation view showing the outdoor unit of the air-conditioner of Embodiment 1 of the present invention. FIG. 3 is the elevation view of a propeller fan installed in the outdoor unit of the air-conditioner of Embodiment 1 of the present invention. FIG. 4 is a cylindrical sectional development diagram of the propeller fan installed in the outdoor unit of the air-conditioner of Embodiment 1 of the present invention. FIG. 5 is a sectional view showing shape of a bell mouth at portion A of FIG. 2. FIG. 6 is a sectional view showing shape of a bell mouth at portion B of FIG. 2. FIG. 7 is another elevation view showing the outdoor unit of the air-conditioner of Embodiment 1 of the present invention. FIG. 8 is a supplemental sectional view illustrating features of the bell mouth of the outdoor unit of the air-conditioner of Embodiment 1 of the present invention. FIG. 9 is a supplemental sectional view illustrating other features of the bell mouth of the outdoor unit of the air-conditioner of Embodiment 1 of the present invention.

In FIGS. 1 and 2, a propeller fan type blower 2 of an outdoor unit 1 of a separate type air-conditioner, which is a heat pump apparatus, is constituted by a propeller fan 3, a bell mouth 4 that surrounds rear edge 3*c* side outer peripheral edge 3*b* of the blade of the propeller fan 3, a blow-out plate 5 in continuation with the bell mouth 4, and a motor 6 that rotates and drives the propeller fan 3. Here, a rotation axis direction denotes the direction perpendicular to the rotation direction of the motor 6.

The blade shape of the propeller fan 3 is an advancing blade shape where a middle point P1 of the outer peripheral edge 3*b* comes ahead of a middle point P2 of a boss side in the rotation direction as shown in FIG. 3, which is a plan view viewed from the blow-out side.

FIG. 4 is a plan development diagram where the outer peripheral edge 3*b* side of the propeller fan 3 is cut at the cylindrical section A-A line of FIG. 3 to be developed into a plane. Regarding an arc length L of the outer peripheral edge 3*b*, which is the propeller fan 3 shown in the plan development diagram developed onto a plane, the outer peripheral edge 3*b* side is longer than the boss side.

The negative pressure face at the cross-section configuration of the outer peripheral edge 3*b* developed into a plane of the propeller fan 3 shown in the plan development diagram of FIG. 4 is a convex to the opposite side of the rotation direction.

The air duct chamber 7 having the propeller fan 3 is surrounded by an upper plate 8, a lower plate 9, a side plate 10, and a machine room plate 11 at the outside four directions in the radial direction of the propeller fan 3 and a face opposing a blow-out plate 5 is covered by a heat exchanger 12. An air duct chamber cross-section perpendicular to the rotation axis direction in the air duct chamber 7 is vertically long when viewed from the front face where the arc length of the side plate 10 and the machine room plate 11 is longer than that of the upper plate 8 and the lower plate 9.

In a machine room 13 which is separated from the air duct chamber 7 by the machine room plate 11, an electrical circuit is stored to control refrigerant circuit configuration elements connected to the heat exchanger 12 and the heat pump apparatus as well as the compressor 14.

The heat exchanger 12 is provided with a multi-layer shaped fin for heat transfer on the outer surface of the pipe in which the refrigerant circulates. The opening of the bell mouth 4 is covered by the protection grill 15.

The part A of FIG. 2 shows, as shown by the sectional view of FIG. 5, a portion where the air duct chamber space outside the radial direction of the propeller fan 3 abruptly extends when viewed from the rotating propeller fan 3 side. That is, the part A of FIG. 2 is located at a position where when proceeding along the fan rotation direction viewed from the front face of the outdoor unit 1 from a point where the side plate 10 and the blade of the propeller fan 3 approach the most, the distance between the side plate 10 and the blade extends.

Part B of FIG. 2 shows, as shown by the sectional view of FIG. 6, that the air duct chamber space outside the radial direction of the propeller fan 3 is a wide space when viewed from a rotating propeller fan 3 side.

Both part A and part B of FIG. 2 are formed, as shown by FIGS. 5 and 6, such that a portion at a suction side in the vicinity of a minimum inner diameter portion of the bell mouth 4 having a radius of curvature R1 is connected to a portion further to the suction side with a radius of curvature R2 larger than R1. As shown in FIGS. 5 and 6, the radius of curvature R2 is extremely large and the cross-section is almost a straight line. The radius of curvature R1 is almost the same size over all circumferences.

With a spreading angle θ1 from the rotation axis at the suction side of the bell mouth 4, the part A is made smaller where space is more abruptly changes than the part B having a broader air duct chamber space outside the radial direction of the bell mouth 4. The space gradually changes between the part A and the part B in FIG. 2. Regarding the overlapped height Hb of the bell mouth 4 and the propeller fan 3 in the rotation axis direction, the part A is higher than the part B.

The part C of FIG. 1 is located in the fan rotation direction side with respect to the intersection direction of the upper plate 8 and the machine room plate 11 when viewing the outdoor unit 1 from the front face. It is a portion where the air duct chamber space outside the radial direction of the propeller fan 3 becomes narrow when viewed from the propeller fan 3 side. The cross-section shape of the bell mouth 4 of this portion is like the one of the part A such that a suction side adjacent to the minimum inner radius portion of the bell mouth 4 is connected to further closer to the suction side with a larger radius of curvature and the overlapped height of the bell mouth 4 and the propeller fan 3 in the rotation axis direction is higher than the part B.

There is a restriction on dimensions as the outdoor unit 1 at a immediately lateral position to where the side plate 10 and the blade of the propeller fan 3 approaches the most when viewed from the front face of the outdoor unit 1. Therefore, in consideration of the shape of the bell mouth 4, it is difficult to reduce noises. In the present invention, the shape of the bell mouth 4 is considered like the above for reducing noises of the part A and the part B in FIG. 2, in which there is not many restrictions.

Next, descriptions will be given to operation of the outdoor unit of the air-conditioner according Embodiment 1 of the present invention.

When the propeller fan 3 is rotated by the drive force of the motor 6, the gas in the air duct chamber 7 passes through the protection grill 15 from the opening of the bell mouth 4 to outside of the outdoor unit by pressure-boosting action of the propeller fan 3. At the same time, gases outside the outdoor unit flow into the air duct chamber 7 through between fins of the heat exchanger 12.

In the pipe of the heat exchanger 12, a refrigerant having a temperature higher or lower than the gases outside the outdoor unit circulates to perform heat exchange when the gases outside the outdoor unit pass through the heat exchanger 12.

When flowing into the air duct chamber 7, the gas whose temperature is increased or decreased through the heat exchange with the heat exchanger 12 is blown outside of the outdoor unit through the rotation of the propeller fan 3 as mentioned before. The larger the airflow volume, the larger the heat exchange amount can be made.

Detailed descriptions will be given to the air flow around the propeller fan 3.

When the propeller fan 3 rotates, the gas in the area where the propeller fan 3 rotates is pushed out into the blow-outside space and the rotation area of the propeller fan 3 comes to have a negative pressure, causing the gas in the air duct chamber 7 to flow into the area where the propeller fan 3 rotates.

The gas in the air duct chamber 7 flows into the propeller fan 3 from the face formed of the rotary locus of the blade leading edge 3*a* of the propeller fan 3 and the face formed of the rotary locus of the outer peripheral edge 3*b* of the blade.

Part of the gas flowed into the propeller fan 3 becomes a leakage flow from a pressure face oriented to the rotation direction of the propeller fan 3 to the negative pressure face opposite to the pressure face via outside of the outer peripheral edge 3*b*.

Based on the leakage flow generated in the vicinity of the leading edge 3*a* of the outer peripheral edge 3*b*, a flow having a vortex structure called a blade end vortex is generated at a position along the outer peripheral edge 3*b* of the negative pressure face.

The blade end vortex grows while moving from the leading edge side to the rear edge side to be removed from the outer peripheral edge in the vicinity of the half position of the blade outer-periphery where turn of the flow becomes large.

The blade end vortex removed from the outer peripheral edge 3*b* weakens the structure as the vortex to be gradually discharged out of the outdoor unit while being pushed away by a total flow.

In the vicinity of the blade rear edge 3*b*, a flow flowing into the fan rotation area becomes a main flow, however, as mentioned above, some flow flows out of the rotation area. Furthermore, the blade end vortex does exist. Accordingly, aerodynamic performance of the blower 2 is largely dependent on the air duct chamber space outside the radial direction of the propeller fan 3.

When viewed from the rotating propeller fan 3, an abrupt change in the space of the air duct chamber 7 outside the radial direction causes the flow around the propeller fan 3 to be unstable. As a result, change in pressure on the face of the propeller fan 3 becomes large to increase noises. Change in pressure on the face of the bell mouth 4 becomes large as well to increase noises.

The blade of the rotating propeller fan 3 approaches the side plate 10 the most at the horizontal position passing through the rotation axis center. Then, the air duct chamber outside the radial direction of the propeller fan 3 becomes the narrowest at the side plate 10 side. Thereafter, the air duct chamber space outside the radial direction gradually becomes wider as the propeller fan 3 approaches the part A of FIG. 2. In the vicinity of the part A, the distance between the propeller fan 3 and the side plate 10 abruptly increases, causing the air duct chamber outside the radial direction of the fan outer-periphery to be widened abruptly.

In Embodiment 1, since the overlapped height Hb of the propeller fan 3 and the bell mouth 4 is relatively made large at the part A in FIG. 2, an abrupt change in the air duct chamber space becomes less because of the bell mouth 4 having a small expansion angle at the bell mouth suction side in the air chamber, so that variations in the air flow flowing through the propeller fan caused by the abrupt change in the air duct chamber space is suppressed, resulting in low aerodynamic noises.

From the part A to the part B, as mentioned above, since the cross-section of the bell mouth 4 shifts mildly the overlapped height Hb of the propeller fan 3 and the bell mouth 4, the change in the air duct shape outside the outer peripheral edge can be made to be smooth, allowing variations in the flow in the vicinity of the outer-periphery of the fan to be suppressed to cause to reduce aerodynamic noises.

In the part B shown in FIG. 1, the spreading angle θ1 at the cross-section of the bell mouth is made to be relatively large to widen the outside space of the fan outer peripheral edge. By making the area that takes in a required flow amount into the propeller fan 3 to be large, it is possible to reduce the flow speed and suppress aerodynamic noises at the suction section.

Since the distance between the surface of the bell mouth 4 and the propeller fan 3 is large, change in pressure on the surface of the bell mouth caused by change in the flow in the vicinity of the outer-periphery edge of the fan such as a blade end vortex becomes small, allowing generated noises to be small.

When the blade of the rotating propeller fan 3 is moving toward the part C through the part B shown in FIG. 2, since the cross-section of the bell mouth 4 gradually changes, it is possible to make the change in the air duct shape outside the outer-periphery edge to be smooth, allowing the change in the flow in the vicinity of the outer-periphery of the fan to be reduced to suppress increase in aerodynamic noises.

In the vicinity of the part C shown in FIG. 2, the distance between the propeller fan 3 and the machine room plate 11 is abruptly reduced, causing the air duct chamber space outside the radial direction of the outer-periphery of the fan to be abruptly narrow. In Embodiment 1, since the overlapped height Hb of the propeller fan 3 and the bell mouth 4 is relatively made large in the part C as well as the part A, change in the air flow flowing the propeller fan originated from the abrupt change in the air duct chamber space can be suppressed and aerodynamic noises can be lowered.

Preferably, in the parts A and B of FIG. 2, the overlapped height Hb of the propeller fan 3 and the bell mouth 4 is larger than half of the height Hf of the outer-periphery of the fan.

The position of half of the outer-periphery height of the fan is the position that the blade end vortex leaves from the blade face, therefore, change in the flow in the vicinity of the outer-periphery of the fan is large. By covering the portion by the bell mouth 4, the blade end vortex will be stabilized and change in the flow originated from the blade end vortex is suppressed to allow aerodynamic noises of the propeller fan 3 to be small.

In the above, descriptions are given to the upper side of the horizontal plane including the rotation axis, however, it is the same for the lower side. The parts D, E, and F shown in FIG. 7 corresponds to the parts A, B, and C. By making the cross-section of the bell mouth to be the same shape as is formed from the part A to the part C, the same flow as is described above related to the part A to the part C can be achieved to allow aerodynamic noises to be small.

Ways and means for the cross-section of the bell mouth offer the effect of noise reduction even with the upper side or the lower side. When provided with both the upper side and the lower side, large noise-reduction effect will be obtained.

Descriptions will be added related to the cross-section shape of the bell mouth 4.

By making the radius of curvature R1 at the suction side adjoining the minimal inside diameter section of the bell mouth 4 to be the same for a whole circumference, a flow vector along the surface of the bell mouth shown by the symbol S in FIG. 8 can be uniformized at the whole circumference. Thereby, change in flow in the vicinity of the rear edge side 3*c* of the outer peripheral edge 3*b* of the propeller fan 3 can be made small to allow aerodynamic noises to be small.

By making the upstream from the radius R1 of curvature to be a larger radius R2 of curvature, the distance between the outer-periphery edge of the fan and the surface of the bell mouth can be broader than when configuring the cross-section of the bell mouth with the same radius of curvature from the minimal inside diameter section of the conventional bell mouth in general as shown by the broken line 16 in FIG. 9. Thereby, the area for sucking the flow into the propeller fan 3 can be made large, it is possible to reduce the flow speed and suppress aerodynamic noises.

Since the distance between the surface of the bell mouth 4 and the propeller fan 3 is large, change in pressure on the surface of the bell mouth caused by change in the flow in the vicinity of the outer-periphery edge of the fan such as a blade end vortex becomes small, allowing generated noises to be small.

Descriptions will be added related to the blade shape of the propeller fan 3.

Since the propeller fan 3 has a blade in which the arc length of the outer peripheral edge 3*b* side is longer than that of at the boss side, with an advancing blade shape, the shape of the propeller fan 3 is protruded to the rotation direction at the outer peripheral edge 3*b* side of the leading edge 3*a*. The vertical vortex generated from the protruded section of the outer peripheral edge 3*b* and the leading edge 3*a* becomes strong and a large blade end vortex is generated based on the vertical vortex at the outer peripheral edge 3*b* side along the outer peripheral edge of the negative pressure face side.

The blade end vortex enhances a suction force from a peripheral side to the propeller fan 3 and has a noise-reduction effect. However, noise increase is accompanied due to the interference in the bell mouth 4 and the propeller fan 3 by the vortex, which is a flow having large changes.

Although changes in the air duct space outside the radial direction viewed from the blade of the rotating propeller fan 3 make the vortex unstable to disturb the flow, since changes in the suction space of the outer circumference of the fan can be made to be smooth through the combination with the shape of the bell mouth of the above-mentioned Embodiment 1, it is possible to enhance the stability of the blade end vortex and to reduce noises.

With the blade of the propeller fan 3, a negative pressure face has a convex warp in the reverse rotation direction. Suitable warp turns directions of the flow passing through the blade to reduce the relative speed of the gas viewed from the blade and enhance a pressure-boosting action.

Resultantly, rotation speed of the fan is decreased and noise-reduction effect can be obtained. In the vicinity of the outer-periphery edge, the blade end vortex is easy to leave from the blade face at almost half of the blade height where the warp is maximum.

When viewed from the rotating propeller fan 3, since the overlapped height Hb of the bell mouth 4 and the propeller fan 3 in the direction of the rotation axis is made large in the parts A, C, D, and F where the air duct chamber space outside the radial direction abruptly spreads, changes in the blade end vortex can be suppressed to achieve low noise. In particular, by making the overlapped height Hb higher than the half of the outer-periphery height of the fan, its effect is enhanced.

As mentioned above, according to Embodiment 1, a low-noise blower can be obtained. Further a low-noise heat pump apparatus as an outdoor unit 1 of an air-conditioner in which the blower 2 is installed can be obtained.

Assuming that noises are the same as the conventional blower, the blower having much airflow volume can be obtained. That is, the heat pump apparatus having high heat exchange processing ability and excellent energy-saving characteristics can be obtained.

Embodiment 2

Figure 10:
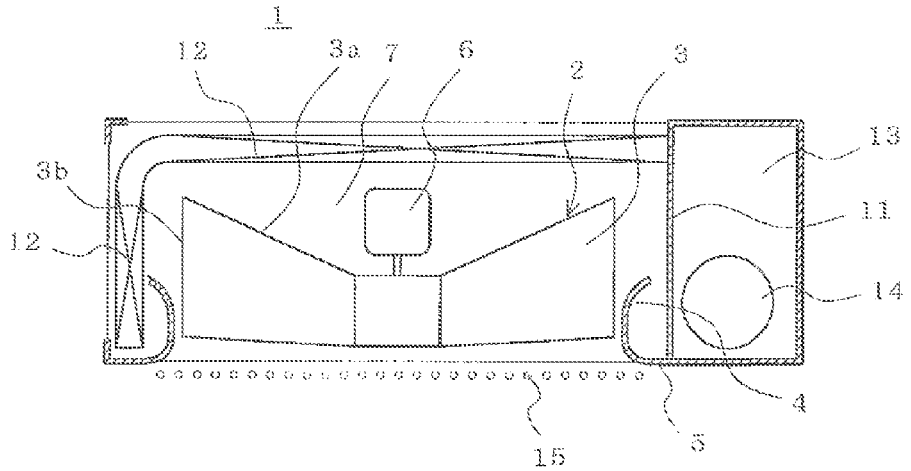
FIG. 10 is a horizontal sectional view showing an outdoor unit of an air-conditioner of Embodiment 2 of the present invention.
Figure 11:
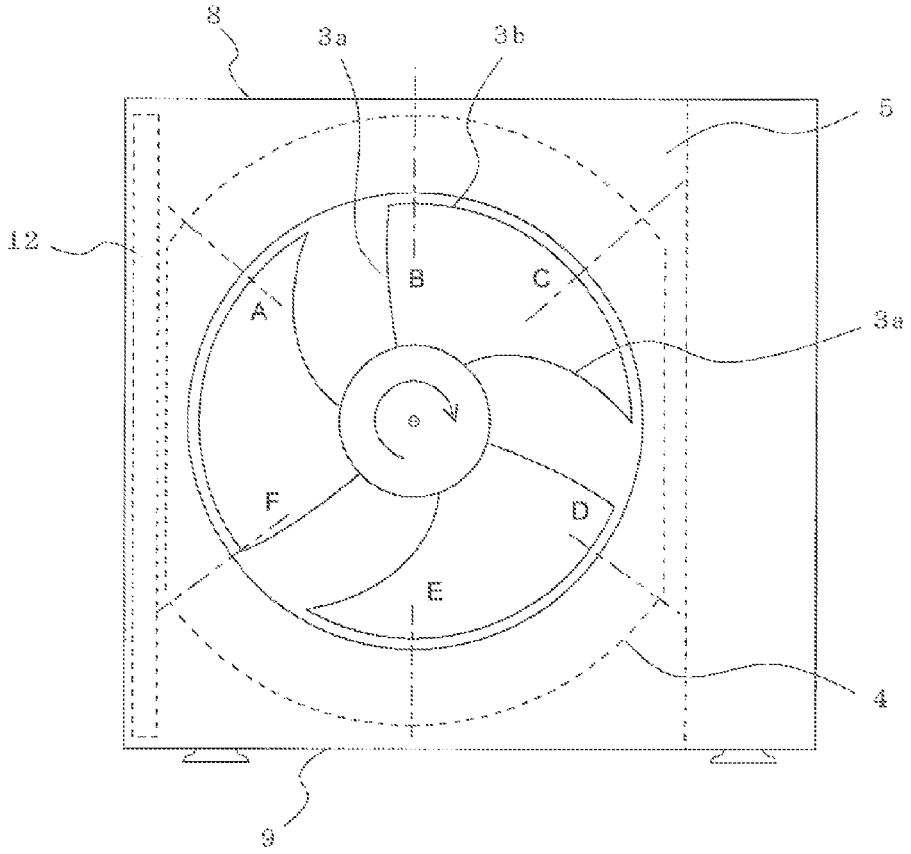
FIG. 11 is an elevation view showing the outdoor unit of the air-conditioner of Embodiment 2 of the present invention.

FIG. 10 is a horizontal sectional view showing the outdoor unit of the air-conditioner of Embodiment 2 of the present invention. FIG. 11 is an elevation view showing the outdoor unit of the air-conditioner. A protection grill is omitted.

While the opposite side of the machine room 13 is the side plate 10 when viewed from the front face of the propeller fan 3 in Embodiment 1, the opposite side of the machine room 13 is the heat exchanger 12 in Embodiment 2. The face opposing the blow-out plate 5 is covered by the heat exchanger 12 like Embodiment 1.

In the vicinity of the propeller fan 3, degree of a negative pressure is strong and when there is the heat exchanger 12, which is a resistive element that makes a gas to pass through to outside the radial direction near the propeller fan 3, the speed of the gas flowing into the propeller fan 3 changes according to the distance from the propeller fan 3. Therefore, changes in air flow around the blade of the propeller fan 3 grow when passing through the portion.

However, in Embodiment 2, since the overlapped height of the propeller fan 3 and the bell mouth 4 is relatively made large in the parts A and F like Embodiment 1, changes in the air flow flowing through the propeller fan originated in abrupt changes in the air duct chamber space can be suppressed, allowing aerodynamic noises to decrease.

In addition, actions and effects described in Embodiment 1 are the same in Embodiment 2.

As mentioned above, according to Embodiment 2, a low-noise blower can be obtained. Further a low-noise heat pump apparatus as an outdoor unit 1 of an air-conditioner in which the blower is installed can be obtained.

Assuming that noises are the same as the conventional blower, the blower having much airflow volume can be obtained. That is, the heat pump apparatus having high heat exchange processing ability and excellent energy-saving characteristics can be obtained.

Figure 12:
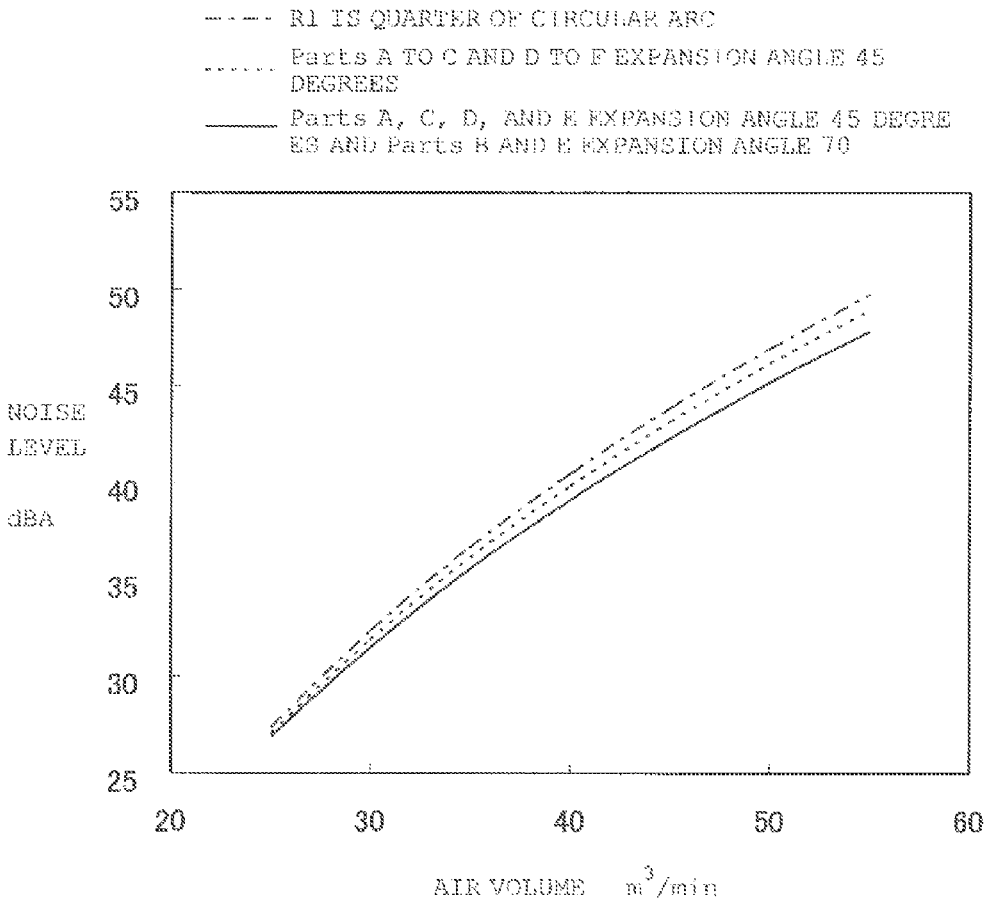
FIG. 12 is a graph showing a comparison of aerodynamic characteristics of the outdoor unit of the air-conditioner of Embodiment 2 of the present invention with conventional unit.

FIG. 12 shows results of experimental check of the low-noise effect of the outdoor unit of the air-conditioner in Embodiment 2. Using a propeller fan of an outer diameter 490 mm, a general specification (dashed-dotted line) in which an expanded portion of a quarter of a circular arc with the radius of curvature R1=30 mm is made to be all circumferences at the suction side adjoining the minimal inside diameter section of the bell mouth, the specification (broken line) in which the expanded portion is connected from R1 to the suction side and the expansion angle of the whole circumference is made to be 45 degrees, and the specification (solid line) in which according to the present embodiment, the expansion angle of the parts A, C, D, and F is made to be 45 degrees and that of the parts B and E 70 degrees.

When seeing FIG. 12, a specification in which the expanded portion is connected with the suction side at the upstream with the expansion angle of 45 degrees can achieve low-noise compared with the specification in which the whole circumference at the suction side is made to be a quarter of a circular arc having the same radius of curvature. It is found that the specification in which the expansion angle according to Embodiment 2 is made to change from 45 degrees to 70 degrees can further achieve low-noise.

Embodiment 3

Figure 13:
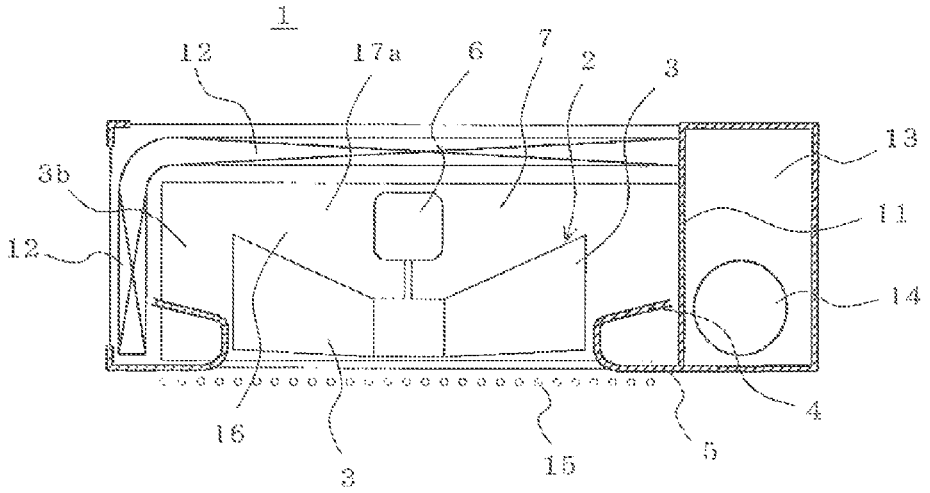
FIG. 13 is a horizontal sectional view showing an outdoor unit of a heat pump type water heater of Embodiment 3 of the present invention.
Figure 14:
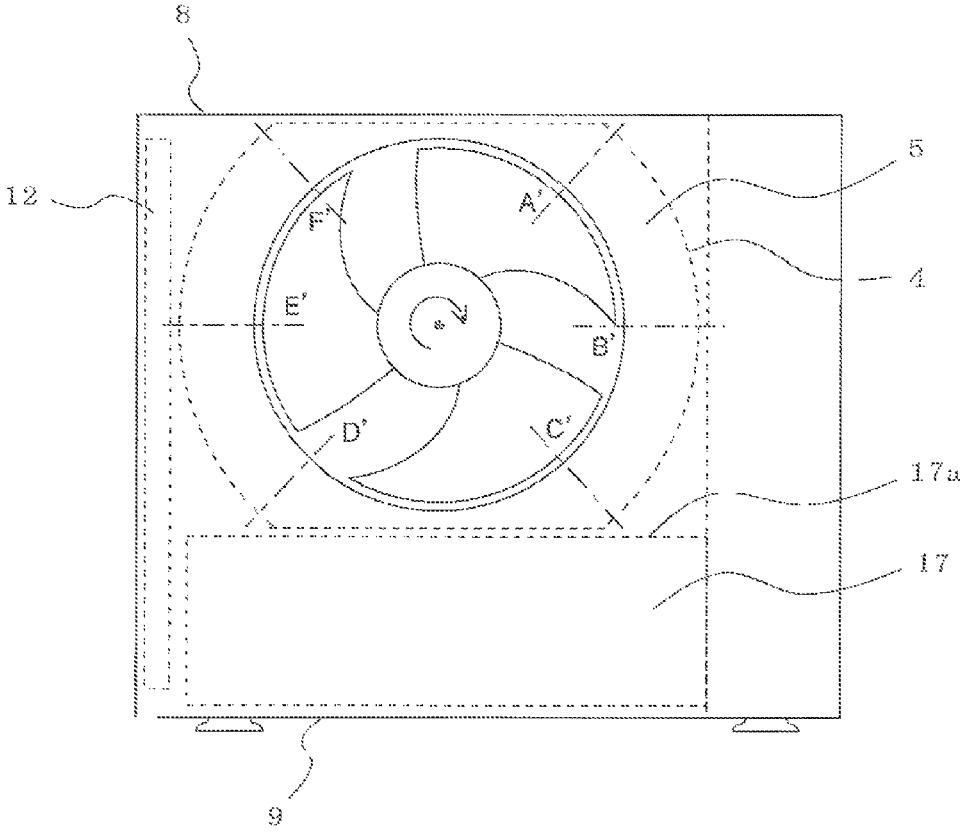
FIG. 14 is an elevation view showing the outdoor unit of the heat pump type water heater of Embodiment 3 of the present invention.

FIG. 13 is a horizontal sectional view showing an outdoor unit of a heat pump type water heater of Embodiment 3. FIG. 14 is an elevation view showing the outdoor unit of the heat pump type water heater, the protection grill being omitted. In Embodiment 3, the heat exchanger 12 is located at the opposite side of the machine room 13 like Embodiment 2, the face opposing the blow-out plate 5 is covered by the heat exchanger 12, and a water heat exchanger 17 is installed that performs heat exchange between the refrigerant and water at the lower part in the outdoor unit 1.

The water heat exchanger 17 occupies the lower part in the outdoor unit 1 and the upper face 17*a* of the air duct chamber becomes a face of the board constituting the air duct chamber 7.

That is, the cross-section of the air duct chamber 7 is a horizontally long shape viewed from the front face such that the length of the heat exchanger 12 and machine room plate 11 is shorter than the length of the upper plate 8 and the upper face 17*a* of the water heat exchanger. Parts A', C', D', and F' correspond to FIG. 5. Parts B' and E' correspond to FIG. 6.

Actions and effects described in Embodiment 1 can be obtained for Embodiment 3. A low-noise blower can be obtained by Embodiment 3. Further, as an outdoor unit of a heat pump type water heater on which the blower is installed, a low-noise heat pump apparatus can be obtained.

Assuming that noises are the same as the conventional blower, the blower having much airflow volume can be obtained. That is, the heat pump apparatus having high heat exchange processing ability and excellent energy-saving characteristics can be obtained.

In the above-mentioned Embodiments 1 to 3, examples are given to cases where the upper plate 8, the lower plate 9, the side plate 10, and the machine room plate 11 are located in the vicinity of outside the radial direction of the propeller fan 3. However, it goes without saying that the present invention can be applied to a case where, for example, only the upper plate 8 is located in the vicinity of outside the radial direction of the propeller fan 3 and other plates are located at far remote place outside the radial direction of the propeller fan 3.

INDUSTRIAL APPLICABILITY

Descriptions are given to the outdoor unit of the air-conditioner and the outdoor unit of the heat pump type water heater as an example of the application of the blower according to the present invention, however, it is possible to be widely used for various apparatuses and equipment in which the blower is installed such as a ventilator.

REFERENCE SIGNS LIST

1 outdoor unit of air-conditioner
2 blower
3 propeller fan
3*a* leading edge
3*b* outer peripheral edge
3*c* rear edge side
4 bell mouth
5 blow-out plate
6 motor (propeller fan drive unit)
7 air duct chamber
8 upper plate
9 lower plate
10 side plate
11 machine room plate
12 heat exchanger
13 machine room
14 compressor
15 protection grill
16 broken line

The invention claimed is:

1. A blower, comprising:

a propeller fan;

a propeller fan drive unit that rotates and drives the propeller fan;

a bell mouth that surrounds a rear end of a rear edge side outer peripheral edge of the propeller fan; and a first flat plate and a second flat plate each disposed in parallel with a rotation axis of the propeller fan at an outside of the propeller fan in a radial direction of the propeller fan, and configuring an air duct from a suction side of the propeller fan to a blow-out side of the propeller fan, the flat plates neighboring each other, wherein the first flat plate and the second flat plate are directly next to each other, a distance between the first flat plate and the propeller fan is shorter than a distance between the second flat plate and the propeller fan, the bell mouth includes a first position having a distance between said first position and the first flat plate that is less than a distance between the first position and the second flat plate and that opposes the first flat plate in a radial direction of the propeller fan and a second position having a distance between said second position and the second flat plate that is less than a distance between the second position and the first flat plate and that opposes the second flat plate in a radial direction of the propeller fan, a first cross-section of the bell mouth at the first position has a first spreading angle smaller than a second spreading angle of a second cross-section of the bell mouth at the second position, the first and the second spreading angle each being an angle measured from the rotation axis to a suction side of the bell mouth, the first cross-section of the bell-mouth has a first overlapped height taller than a second overlapped height of the second cross-section of the bell mouth, the first and second overlapped height being an overlapped height of the propeller fan and the bell mouth in a direction of the rotation axis, and a shape of a cross-section of the bell mouth is made to change between the first position and the second position along a circumferential direction of the bell mouth, a spreading angle of the suction side of the bell mouth gradually increases as a position of the bell mouth approaches from the first position to the second position, and the overlapped height of the propeller fan and the bell mouth gradually decreases as a position of the bell mouth approaches from the first position to the second position.

2. The blower of claim 1, wherein the overlapped height at the first cross-section is equal to or larger than half of an outer-periphery height of the propeller fan.

3. The blower of claim 1, wherein the bell mouth includes a cylindrical section having a minimal inside diameter and an expansion section connecting to the cylindrical section at an upper stream side of the cylindrical section, the expansion section expanding an inside diameter from the blow-out side of the propeller fan toward the suction side of the propeller fan, and a radius of curvature of a first portion of the expansion section next to the cylindrical section is the same for a whole circumference.

4. The blower of claim 3, wherein the radius of curvature of the first portion of the expansion section next to the cylindrical section is smaller than a radius of curvature of a second portion of the expansion section extending from the first portion toward the suction side of the propeller fan.

5. The blower of claim 1, wherein a blade shape of the propeller fan is an advancing blade; and an arc length of the blade at a peripheral edge is longer than at a boss side.

6. The blower of claim 1, wherein a negative pressure face of a blade of the propeller fan is convex to an opposite side of a rotation direction in a cylindrical cross-section with the rotation axis being a center.

7. A heat pump apparatus, comprising;

the blower of claim 1, a heat exchanger provided at a suction side of the air duct, wherein a distance between the first flat plate and the rotation axis of the propeller fan is smaller than a distance between the second flat plate and the rotation axis of the propeller fan.

8. The heat pump apparatus of claim 7, wherein the first flat plate is the heat exchanger.

9. The heat pump apparatus of claim 7, wherein the first flat plate and the second flat plate are plates without ventilation property.

10. The heat pump apparatus of claim 7, wherein the first spreading angle is 45° and the second spreading angle is 70°.

11. The blower of claim 1, wherein the first flat plate and the second flat plate are plates without ventilation property.

12. The blower of claim 1, wherein the first spreading angle is 45° and the second spreading angle is 70°.

* * * * *